US011766706B2

(12) United States Patent
Li et al.

(10) Patent No.: US 11,766,706 B2
(45) Date of Patent: Sep. 26, 2023

(54) SPARK RECOGNITION-BASED HOT-ROLLED COILING SIDE GUIDE PLATE CONTROL METHOD

(71) Applicant: Baoshan Iron & Steel Co., Ltd., Shanghai (CN)

(72) Inventors: Jiabo Li, Shanghai (CN); Hongfeng Sun, Shanghai (CN); Jianrong Chen, Shanghai (CN); Jianmin Zhang, Shanghai (CN)

(73) Assignee: Baoshan Iron & Steel Co., Ltd., Shanghai (CN)

( * ) Notice: Subject to any disclaimer, the term of this patent is extended or adjusted under 35 U.S.C. 154(b) by 0 days.

(21) Appl. No.: 17/776,892

(22) PCT Filed: Sep. 15, 2020

(86) PCT No.: PCT/CN2020/115226
§ 371 (c)(1),
(2) Date: May 13, 2022

(87) PCT Pub. No.: WO2021/098357
PCT Pub. Date: May 27, 2021

(65) Prior Publication Data

US 2022/0402008 A1 Dec. 22, 2022

(30) Foreign Application Priority Data

Nov. 21, 2019 (CN) ..... 201911149731.1

(51) Int. Cl.
*B21B 37/68* (2006.01)
*B21B 37/16* (2006.01)
(Continued)

(52) U.S. Cl.
CPC ..... *B21B 37/68* (2013.01); *B21B 37/16* (2013.01)

(58) Field of Classification Search
CPC ..... B21B 37/68; B21B 37/16; B21B 38/00; B21B 39/14; B21B 39/16; B21B 2273/04;
(Continued)

(56) References Cited

U.S. PATENT DOCUMENTS

2015/0082848 A1* 3/2015 Ito ..... B21B 38/00 72/31.07

FOREIGN PATENT DOCUMENTS

CN 101224471 A 7/2008
CN 101581944 A 11/2009
(Continued)

OTHER PUBLICATIONS

English translate (CN103801566A), retrieved date May 31, 2023.*
(Continued)

*Primary Examiner* — Matthew Katcoff
*Assistant Examiner* — Mohammed S. Alawadi
(74) *Attorney, Agent, or Firm* — Burns & Levinson LLP; Alexander J. Smolenski, Jr.

(57) ABSTRACT

The present invention discloses a control method of hot mill coiler side guides based on spark recognition, where the side guides are adjusted according to the width of sparks from the friction between the hot rolled strip (20) and the side guides (11). An industrial camera (9) is provided obliquely above the side guides (11), and a detection system implements a real-time analysis on the images taken by the industrial camera and determines the magnitude of sparks generated on either side of the side guides according to the spark width. For each unilateral side guide, it is adjusted according to the spark width $M_S$ corresponding to that side guide (11). For said unilateral side guide (11), the deviation of the single-side spark width $\Delta M_S$ is obtained according to $\Delta M_S = M_S - M_{aim}$. The position adjustment magnitude $\Delta W_S$ of the unilateral side guide (11) can be obtained according to formula
(Continued)

(I). And the pressure adjustment magnitude $\Delta P_S$ of the unilateral side guide (11) can be obtained according to formula (II). This method allows the hot rolled strip (20) always in the relative center of the steel coil, reduces the wear of the side guides (11), avoids various defects of the steel coil, and makes the steel coil in good shape.

12 Claims, 3 Drawing Sheets

(51) Int. Cl.

| | |
|---|---|
| ***B21C 51/00*** | (2006.01) |
| ***B21C 47/34*** | (2006.01) |
| ***B21B 38/00*** | (2006.01) |
| ***B21B 39/14*** | (2006.01) |

(58) Field of Classification Search
CPC ..... B21B 2015/0057; B21C 51/00; B21C 47/3416; B21C 47/02; B21C 47/04
See application file for complete search history.

(56) References Cited

FOREIGN PATENT DOCUMENTS

| | | | | |
|---|---|---|---|---|
| CN | 102120224 | A | | 7/2011 |
| CN | 102896180 | A | | 1/2013 |
| CN | 102989839 | A | | 3/2013 |
| CN | 103801566 | A | * | 5/2014 |
| CN | 103801566 | A | | 5/2014 |
| CN | 104254409 | A | | 12/2014 |
| CN | 106238473 | A | | 12/2016 |
| CN | 106269994 | A | * | 1/2017 |
| JP | 2006-263779 | A | | 10/2006 |

OTHER PUBLICATIONS

English translate (CN106269994A), retrieved date May 31, 2023.*
International Searching Authority/CN, International Search Report and Written Opinion of the International Searching Authority, Application No. PCT/CN2020/115226, dated Dec. 2, 2020, 11 pages (with English translation of the International Search Report).

* cited by examiner

SPARK RECOGNITION-BASED HOT-ROLLED COILING SIDE GUIDE PLATE CONTROL METHOD

CROSS-REFERENCE TO RELATED APPLICATIONS

This application is a U.S. national phase entry under 35 USC § 371 of Patent Cooperation Treaty Application No. PCT/CN2020/115226 filed Sep. 15, 2020, which in turn claims priority from Chinese Patent Application 201911149731.1 filed Nov. 21, 2019. Each of the above described applications which is incorporated herein by reference in their entireties.

TECHNICAL FIELD

The present invention relates to the coiling equipment of hot rolled plates, and to a control method of hot mill coiler side guides based on spark recognition.

BACKGROUND

The existing coiling related equipment of a hot rolled strip 20 can refer to FIG. 1 (excluding the industrial camera 9), and along the running direction of the hot mill, it sequentially comprises hot mill stands, a width gauge 8, a laser detector 10, side guides 11, coiler pinch rolls 12 and a coiler 16. The coiler 16 and the coiler pinch rolls 12 are used to coil the hot rolled strip 20, and the side guides 11 are used to guide the hot rolled strip 20 to enter the coiler pinch rolls 12 and a coiler 16 correctly and prevent the hot rolled strip 20 from deviating. The width gauge 8 is used to measure the width of the hot rolled strip 20, the laser detector 10 is used to detect the position of the hot rolled strip 20, and the length of the parallel section of the side guides is 4~8 m. Moreover, the coiling equipment of the hot rolled strip 20 further comprises a detection system, which is used to collect data information fed back by the hardware and perform relevant data analysis. The detection system is usually implemented by an industrial personal computer. After the hot rolled strip 20 comes out from the tail roll of the hot mill, it enters the coiling process.

In the controlled process of hot continuous rolling and coiling, the control of side guides is vital, which directly related to the edge quality and the shape quality of the hot rolled strip 20.

The existing control system mainly adopts a method of the short stroke preset to control the opening of side guides, that is, in different stages of the coiling process, the opening between the two side guides 11 is adjusted to a preset opening. During the whole controlled process, if the controlled opening of side guides is too small, on the one side, it is easy to cause serious strip edge damage or even steel jamming; on the other hand, it will lead to the localized wear of the side guides, shortening its service cycle. If the controlled opening of side guides is too large, it will lead to problems such as coil towers and coil edge misalignment. The basic reason of these problems is that after the hot rolled strip 20 enters the coiler pinch rolls 12, it is difficult to ensure that the side guides 11 exert symmetrical and moderate pressure on both sides of the hot rolled strip 20, and in the subsequent coiling process, the strip runs along the front center line.

For above-mentioned situations, patents CN200810037476 and CN201410442427 adopt alternate control of the pressure and the position of side guides to ensure stable clamping force of side guides on both sides of the strip. Patent KR900675B1 compares the standard rolling force and preset noise with the measured rolling force and measured noise to determine whether the strip is twisted, to finally control the position of side guides. Patent JP2006263779A discloses that the bending amount of the strip can be obtained according to the opening difference or the load difference between the drive side and the work side of the pinch roll, and the opening of the side guides can be corrected according to the bending amount. However, all these patents disclose indirect control methods, the actual clamping force of the side guides on the strip and the position of the centerline of the strip cannot be known.

SUMMARY

The purpose of the present invention is to provide a control method of hot mill coiler side guides based on spark recognition. This method can keep the hot rolled strip in the relative center of the coil, reduce the wear of the side guides, and simultaneously avoid various defect problems of the coil and make the coil in good shape.

In order to achieve the foregoing objective, the present invention provides the following technical solutions.

A control method of hot mill coiler side guides based on spark recognition, said control method comprising:

- step of preparatory opening adjustment: before a hot rolled strip enters the area of the side guides, adjusting the opening of the side guides to a preparatory opening;
- step of installation: installing an industrial camera obliquely above the entrance of the side guides, the range of the industrial camera covering the whole area of each side guide, and the industrial camera transmitting the captured images to a detection system in real time via a communication line;
- step of image analysis: for each unilateral side guide, the detection system implementing a real-time analysis on images of sparks taken by the industrial camera, wherein the sparks come from friction between the unilateral side guide and the hot rolled strip, so as to identify the single spark having a largest transverse width generated on the unilateral side guide, and the transverse width of the spark being recorded as spark width $M_S$;
- step of dynamic adjustment: this step starting from the head of the hot rolled strip reaching the coiler pinch rolls and till the tail of the hot rolled strip is out of the coiler pinch rolls. The step of dynamic adjustment comprises setting a target spark width $M_{aim}$, and performing a dynamic adjusting process for each unilateral side guide. The dynamic adjusting process of side guides comprises: obtaining a spark width deviation $\Delta M_S$ of the unilateral side guide according to a first formula shown as $\Delta M_S = M_S - M_{aim}$, and implementing a controlling adjusting method for the unilateral side guides according to the spark width deviation $\Delta M_S$ of the unilateral side guide. Wherein when the thickness of the hot rolled strip $h_{strip} \leq h$, said controlling adjusting method for side guides is a position controlled adjusting method. When the thickness of the hot rolled strip $h_{strip} > h$, said controlled adjusting method of side guides is a pressure controlled adjusting method, wherein h is a preset reference thickness. Said position controlled adjusting method comprises obtaining a position adjustment magnitude $\Delta W_S$ of side guides for the unilateral side guide according to a second formula shown as $$\Delta W_S = K_{total1} \times \left(K_{P1} + \frac{K_{I1}}{s}\right) \times \Delta M_S,$$

wherein $K_{total1}$ is total gain, $K_{P1}$ is proportional coefficient, $K_{I1}$ is integral coefficient, S is Laplace operator, then obtaining a target position $W_S$ of side guides for the unilateral side guide according to a third formula shown as $W_S=W_S'+\Delta W_S$, wherein $W_S'$ is the position of the unilateral side guide before adjustment, and adjusting the position of the unilateral side guide to the target position $W_S$ of side guides. Said pressure controlled adjusting method comprises obtaining a pressure adjustment magnitude $\Delta P_S$ of the side guides for the unilateral side guide according to a fourth formula shown as $$\Delta P_S = K_{total2} \times \left(K_{P2} + \frac{K_{I2}}{s}\right) \times \Delta M_S,$$

wherein $K_{total2}$ is total gain, $K_{P2}$ is proportional coefficient, $K_{I2}$ is integral coefficient, S is Laplace operator, then obtaining a target pressure $P_S$ of side guides for the unilateral side guide according to a fifth formula shown as $P_S=P_S'+\Delta P_S$, wherein $P_S'$ is the pressure on the unilateral side guide before adjustment, and adjusting the position of the unilateral side guide so that the pressure on the unilateral side guide is consistent with said target pressure $P_S$ of side guides.

Further, said step of dynamic adjustment comprises:

a first dynamic adjusting step: this step starting from the head of the hot rolled strip reaching the coiler pinch rolls and till the tail of the hot rolled strip is out of an F1 stand. This step comprises setting the target spark width $M_{aim}$ as a first target spark width $M_{aim1}$, after the head of the hot rolled strip reaches the coiler pinch rolls, performing a dynamic adjusting process for each unilateral side guide until the head of the hot rolled strip goes out of the coiler pinch rolls by a length of $L_{head}$, wherein $L_{head}$ is a preset length of the strip head. This step further comprises when the head of the hot rolled strip goes out of the coiler pinch rolls by a length that exceeds said length of the strip head $L_{head}$, recording the real-time position of said unilateral side guide as a target lock position $W_{LK}$, then adjusting the position of said unilateral side guide to $W_{LK}+\Delta W_3$, and locking the position of said unilateral side guide until the tail of the hot rolled strip is out of the F1 stand, wherein $\Delta W_3$ is a preset target position margin.

Further, said step of dynamic adjustment further comprises:

a second dynamic adjusting step: this step starts from the tail of the hot rolled strip being out of said F1 stand and till the tail of the hot rolled strip is out of an F7 stand. This step comprises setting the target spark width $M_{aim}$ as a second target spark width $M_{aim2}$, and then performing said dynamic adjusting process for each unilateral side guide.

Further, said step of dynamic adjustment further comprises:

a third dynamic adjusting step: this step starts from the tail of the hot rolled strip being out of said F7 stand until the tail of the hot rolled strip is X meters away from the side guides, wherein X is a preset length parameter. This step comprises setting the target spark width $M_{aim}$ as a third target spark width $M_{aim3}$, and then performing said dynamic adjusting process for each unilateral side guide.

Said step of dynamic adjustment further comprises:

a fourth dynamic adjusting step: this step starts from the tail of the hot rolled strip being X meters away from the side guide until the tail of the hot rolled strip is out of the coiler pinch rolls. This step comprises setting the target spark width $M_{aim}$ as a fourth target spark width $M_{aim4}$ and performing said dynamic adjusting process for each unilateral side guide.

Further, the dynamic adjusting process of side guides in said step of dynamic adjustment further comprises setting amplitude limitation for the position of said unilateral side guide. Said amplitude limitation for the position includes an upper limit of the position $LIM_{up1}$ and a lower limit of the position $LIM_{low1}$, said upper limit of the position $LIM_{up1}$ is obtained according to a sixth formula, and said lower limit of the position $LIM_{low1}$ is obtained according to a seventh formula. Said sixth formula is $$LIM_{up1} = \frac{1}{2} W_{ave} + 50,$$

and said seventh formula is $$LIM_{low1} = \frac{1}{2} W_{ave} - 50,$$

wherein $W_{ave}$ is an average width of the hot rolled strip when it goes out of a width gauge by a length range L1, and L1 is a preset length of width measure. Said width gauge is set at the rear side of the hot mill stand and measures the width of the hot rolled strip out of the mill in real time.

Further, the pressure controlled adjusting method in said step of dynamic adjustment further comprises setting amplitude limitation for the pressure of said unilateral side guide. Said amplitude limitation for the pressure includes an upper limit of the pressure $LIM_{up2}$ and a lower limit of the pressure $LIM_{low2}$. Said upper limit of the pressure $LIM_{up2}$ is obtained according to an eighth formula and said lower limit of the pressure $LIM_{low2}$ is obtained according to a ninth formula. Said eighth formula is $LIM_{up2}=(1+k1)P_{S_aim}$, and said ninth formula is $LIM_{low2}=(1-k1)P_{S_aim}$, wherein the value of k1 ranges from 0~0.5, and $P_{S_aim}$ is a preset target of controlled pressure.

Further, in said step of preparatory opening adjustment, the opening of said side guides to said preparatory opening comprises:

a first preparatory opening adjusting step: when the head of the hot rolled strip is out of a F3 stand, adjusting the opening of the side guides to a first preparatory opening W1, and for each unilateral side guide, adjusting the position of said unilateral side guide to $$\frac{1}{2} W1,$$

and the first preparatory opening W1 being obtained according to a tenth formula. Said tenth formula is $W1=W_{ref}+l_1$, wherein $W_{ref}$ is a target width value of the hot rolled strip given by a process control computer, $l_1$ is the opening margin of side guides, and the value of $l_1$ ranges from 40~60 mm.

Further, in said step of preparatory opening adjustment, adjusting the opening of the side guides to said preparatory opening further comprises:

a second preparatory opening adjusting step: when the head of the hot rolled strip reaches a laser detector, adjusting the opening of the side guides to a second preparatory opening W2, and for each unilateral side guide, adjusting the position of said unilateral side guide to $$\frac{1}{2}W2,$$

and the second preparatory opening W2 being obtained according to a eleventh formula. Said eleventh formula is $W2=W_{ave}+l_{dev}+l_2$, wherein $W_{ave}$ is an average width of the hot rolled strip when it is out of a width gauge by a length range L1, $l_{dev}$ is the deviation of the hot rolled strip when it goes out of the width gauge by the length range L1, wherein L1 is a preset length of width measure, $l_2$ the opening margin of side guides, and the value of $l_2$ ranges from 15~30 mm.

Further, said control method of side guides further comprises:

step of final opening adjustment: when the tail of the hot rolled strip is out of the coiler pinch rolls, and if there is no subsequent hot rolled strip to be coiled, adjusting the opening of the side guides to a final opening W7, said final opening W7 being equal to said first preparatory opening W1 in the first preparatory opening adjusting step, and adjusting the position of each unilateral side guide to $$\frac{1}{2}W7.$$

In the method of the present invention, an industrial camera is installed obliquely above the side guides. The industrial camera is the key device to realize the control and adjustment of the side guides. The main function of the industrial camera is to take the images of the side guides, especially to obtain the images of the sparks generated by the contact friction between the hot rolled strip and the side guides, and to transmit the images to the detection system in real time via a communication line. The detection system implements a real-time analysis on the images of the sparks from the friction between the side guides and the hot rolled strip taken by the industrial camera and identifies the width of the sparks generated on the side guide, and then adjusts the two side guides according to the width of the sparks. In other words, in the present invention, the frictional contact between the side guides and the hot rolled strip is judged on the width of the sparks from the friction between the hot rolled strip and the side guides, and then the side guides can be controlled and adjusted based on this, thus the control method of the side guides is optimized, the hot rolled strip is kept in the relative center of the steel coil, the wear of the side guides is reduced, various defects of the steel coil are avoided, and the steel coil is in good shape.

In the figures: 1 F1 stand, 3 F3 stand, 7 F7 stand, 8 width gauge, 9 industrial camera, 10 laser detector, 11 side guide, 12 coiler pinch roll, 16 coiler, and 20 hot rolled strip.

DETAILED DESCRIPTION OF THE EMBODIMENTS

The present invention is further described below with reference to the accompanying drawings and embodiments.

Figure 1:
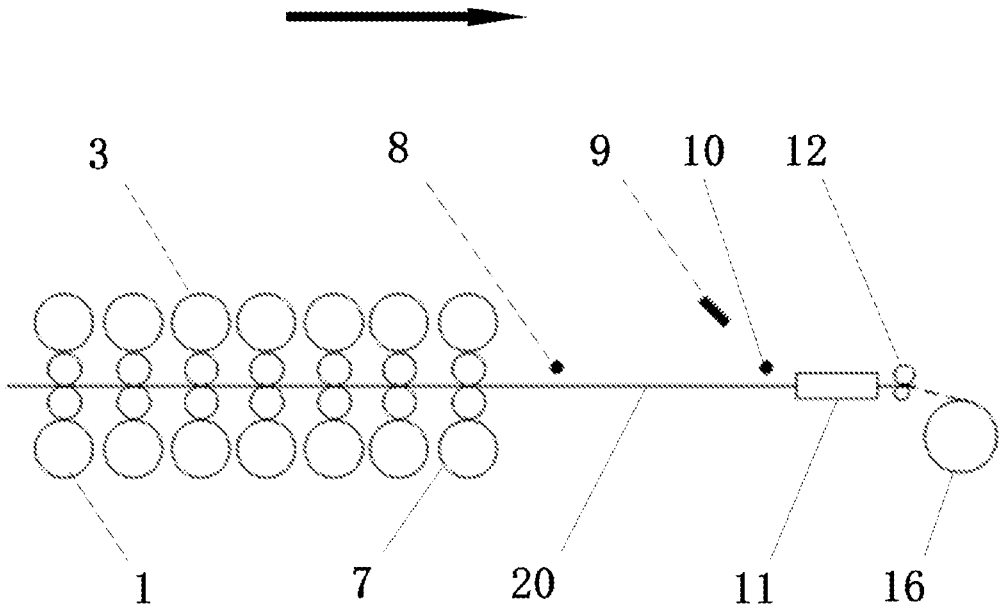
FIG. 1 is a schematic diagram of the equipment arrangement of a hot rolled strip from the hot rolling line to the strip coiling, wherein the arrow in the figure shows the running direction of the hot mill.

Referring to FIGS. 1-4, the present embodiment provides a control method of hot mill coiler side guides based on spark recognition, said control method of side guides is based on the equipment of hot rolling and coiling as shown in FIG. 1. FIG. 1 shows the structure of equipment arrangement from the hot rolling line to the strip coiling. The hot rolled strip 20 out of the hot mill is guided by the side guides 11, and finally enters the coiler 16 to coil and form. Along the running direction of the hot mill, said equipment of hot rolling and coiling sequentially comprises hot mill stands, a width gauge 8, an industrial camera 9, a laser detector 10, side guides 11, coiler pinch rolls 12 and a coiler 16. The coiler 16 and the coiler pinch rolls 12 are used to coil the hot rolled strip 20, and the side guides 11 are used to guide the hot rolled strip 20 to enter the coiler pinch rolls 12 and a coiler 16 correctly and prevent the hot rolled strip 20 from deviating. Said width gauge 8 is set at the rear side of the hot mill stand and measures the width of the hot rolled strip 20 out of the mill in real time. The industrial camera 9 is used to take images of the side guides, the laser detector 10 is used to detect the position of the hot rolled strip 20, and the length of the parallel section of the side guides is 4~8 m.

In addition, a position tracking system of the hot rolled strip 20 is provided in said equipment of hot rolling and coiling to track and determine the specific position of the hot rolled strip 20, including the specific position of the head and tail of the strip. The equipment of hot rolling and coiling further comprises a detection system, where the image data of the side guides 11 obtained from the industrial camera 9 is transmitted to the detection system for analysis via a communication line, which is usually implemented by an industrial personal computer.

Position sensors and pressure sensors are provided on the drive side of said side guides 11, these sensors can obtain the position of the side guides 11 and the pressure applied on the side guides 11 and transmit the position and pressure information of the side guides 11 to the industrial control PLC.

The control method of the side guides in the present embodiment includes the following steps.

The step of preparatory opening adjustment: before a hot rolled strip 20 enters the area of the side guides 11, adjusting the opening of said side guides 11 to a preparatory opening.

More specifically, adjusting the opening of the side guides 11 to a preparatory opening includes a first preparatory opening adjusting step and a second preparatory opening adjusting step. Specifically, the opening of the side guides 11 can be adjusted to the preparatory opening by means of a motor or a hydraulic device.

The first preparatory opening adjusting step: when the head of the hot rolled strip 20 is out of the F3 stand 3, adjusting the opening of the side guides 11 to the first preparatory opening W1, and for each unilateral side guide 11, adjusting the position of said unilateral side guide 11 to ½W1. The first preparatory opening W1 can be obtained according to a tenth formula shown as $W1=W_{ref}+l_1$, wherein $W_{ref}$ is the target width value of the hot rolled strip 20 given by a process control computer, $l_1$ is the opening margin of side guides, and the value of $l_1$ ranges from 40~60 mm.

The second preparatory opening adjusting step: when the head of the hot rolled strip 20 reaches a laser detector 10, adjusting the opening of the side guides 11 to a second preparatory opening W2, and for each unilateral side guide 11, adjusting the position of said unilateral side guide 11 to $$\frac{1}{2}W2.$$

The second preparatory opening W2 can be obtained according to an eleventh formula shown as $W2=W_{ave}+l_{dev}+l_2$, wherein $W_{ave}$ is an average width of the hot rolled strip 20 when it goes out of a width gauge 8 by a length range L1, $l_{dev}$ is the deviation of the hot rolled strip 20 when it goes out of the width gauge 8 by the length range L1, wherein L1 is a preset length of width measure, the value of L1 ranges from 20~50 mm, $l_2$ the opening margin of side guides 11, and the value of $l_2$ ranges from 15~30 mm. Specifically, the above-mentioned deviation is the deviation of the centerline of the hot rolled strip 20 relative to the centerline of the coiler pinch rolls 12.

Before the hot rolled strip 20 enters the area of the side guides 11, the opening of the side guides 11 must be adjusted to the preparatory opening, which is mainly to enable the opening of the side guides 11 to roughly match the width of the hot rolled strip 20, so as to prepare for the subsequent fine adjustments.

When the head of the hot rolled strip 20 is out of the F3 stand 3, the opening of the side guides 11 is adjusted to the first preparatory opening W1, and the first preparatory opening is determined according to the target width $W_{ref}$ of the hot rolled strip 20 given by the process control computer. When the head of the hot rolled strip 20 reaches the laser detector 10, the opening of the side guides 11 is adjusted to the second preparatory opening W2, and the second preparatory opening is determined according to the actual width of the hot rolled strip 20 measured by the width gauge 8.

The step of installation: the industrial camera 9 is installed obliquely above the entrance of the side guides 11, the range of the industrial camera 9 covers the whole area of each side guide 11, and the industrial camera 9 transmits the captured images to the detection system in real time via the communication line.

Figure 2:
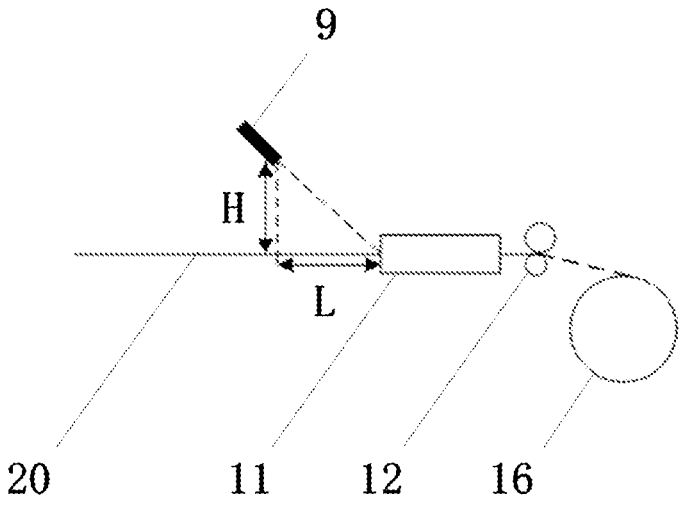
FIG. 2 is a schematic diagram of the position of the industrial camera.
Figure 3:
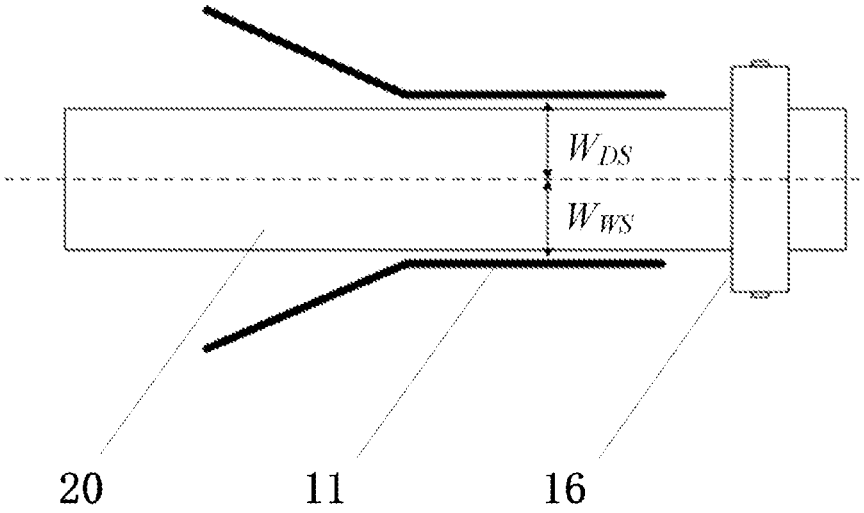
FIG. 3 is atop view of the area of the side guides.

Referring to FIGS. 1-3, the industrial camera 9 is installed obliquely above the entrance of the side guides 11, the range of the industrial camera 9 covers the whole area of each side guide 11. The main function of the industrial camera 9 is to take images of the side guides 11, especially to obtain the images of the sparks from the fraction between the hot rolled strip 20 and the side guides 11 when they are in contact, and to transmit the images in real time to the detection system via a communication line. Said communication line can be a fiber line or a twisted pair communication line. In the present embodiment, the detection system is specifically an industrial personal computer. In the present embodiment, the industrial camera 9 is a high-speed CCD industrial camera capable of taking images at a rate of 25 frames per second or more.

Referring to FIG. 2, the vertical height H of the position where the industrial camera 9 is installed relative to the hot rolled strip 20 is 2~5 m, and the horizontal distance L between the position where the industrial camera 9 is installed and the side guide 11 is 2~10 m, so that the range of the industrial camera 9 can cover the whole area of the side guides 11, and the impact of water mist on the camera can be minimized at this position. In order to have better image capturing results, usually two industrial cameras 9 can be provided, each is pointed to one side of the side guides 11.

The step of image analysis: for each unilateral side guide 11, the detection system implements a real-time analysis on the images of sparks taken by the industrial camera 9, wherein the sparks come from friction between the unilateral side guide 11 and the hot rolled strip 20, so as to identify the single spark having a largest transverse width generated on the unilateral side guide 11, and the transverse width of the spark is recorded as a spark width $M_S$. Specifically, the above-mentioned "transverse" is in the same direction with the width direction of the hot rolled strip 20.

The spark width $M_S$ herein indicates the transverse width of the largest individual spark generated on the unilateral side guide 11. In the subsequent steps of the present embodiment, the spark width $M_S$ is used as a quantitative value to indicate the spark magnitude. In addition to quantifying the spark magnitude by the spark width, other measurements can be used, such as measuring by the spark area in the image or classifying analog quantities such as width or area as described above, creating a spark magnitude classification table, and then determining the corresponding class of the spark according to the table, and using the class to measure the spark. In general, the measurement value of the spark should be a quantitative value that can truly reflect the size of the sparks.

The step of dynamic adjustment: this step starting from the head of the hot rolled strip 20 reaches the coiler pinch rolls 12 till the tail of the hot rolled strip 20 is out of said coiler pinch rolls 12.

This step comprises: setting a target spark width $M_{aim}$, and performing a dynamic adjusting process of side guides for each unilateral side guide 11. The target spark width $M_{aim}$ herein is usually set in the industrial control PLC. Specifically, the value of the target spark width $M_{aim}$ can be set according to the actual situation.

Said dynamic adjusting process for each unilateral side guide comprises: obtaining a spark width deviation $\Delta M_S$ of the unilateral side guide 11 according to a first formula shown as $\Delta M_S=M_S-M_{aim}$, and implementing a controlling adjusting method for the unilateral side guide 11 according to the spark width deviation $\Delta M_S$ of the unilateral side guide 11.

When the thickness of said hot rolled strip 20 (that is the target delivery thickness of the hot continuous rolling and finish rolling) $h_{strip} \leq h$, said controlling adjusting method for side guides is a position controlled adjusting method. When the thickness of said hot rolled strip 20 $h_{strip} > h$, said controlled adjusting method of side guides is a pressure controlled adjusting method, wherein h is a preset reference thickness.

Said position controlled adjusting method comprises: obtaining a position adjustment magnitude $\Delta W_S$ of the side guides for the unilateral side guide 11 according to a second formula shown as $$\Delta W_S = K_{total1} \times \left(K_{P1} + \frac{K_{I1}}{s}\right) \times \Delta M_S,$$

wherein $K_{total1}$ is total gain. The value of $K_{total1}$ is mainly considering the response capability of the actuator of the position of the side guides. $K_{P1}$ is proportional coefficient, whose value is mainly considering the deviation of per unit width of the spark and the position of the side guides to be moved. $K_{I1}$ is integral coefficient, whose value needs to take into account the speed and stability of the control system. Wherein the specific value of $K_{total1}$, $K_{P1}$ and $K_{I1}$ can be selected according to the actual adjustment results in the implementation process. S is Laplace operator, $$\frac{1}{s}$$

indicates the integration of the spark width deviation $\Delta M_S$. Then the target position $W_S$ of side guides for the unilateral side guide 11 can be obtained according to a third formula shown as $W_S=W_S'+\Delta W_S$, wherein $W_S'$ is the position of the unilateral side guide 11 before adjustment, and then the position of the unilateral side guide 11 is adjusted to the target position $W_S$ of side guides.

Said pressure controlled adjusting method comprises obtaining a pressure adjustment magnitude $\Delta P_S$ of the side guides for the unilateral side guide 11 according to a fourth formula shown as $$\Delta P_S = K_{total2} \times \left(K_{P2} + \frac{K_{I2}}{s}\right) \times M_S,$$

wherein $K_{total2}$ total gain. The value of $K_{total2}$ is mainly considering the response capability of the actuator of the pressure on the side guides. $K_{P2}$ is proportional coefficient, whose value is mainly considering the deviation of per unit width of the spark and the pressure on the side guides to be adjusted. $K_{I2}$ is integral coefficient, whose value needs to take into account the speed and stability of the control system. S is the Laplace operator, $$\frac{1}{s}$$

indicates the integration of the spark width deviation $\Delta M_S$. Then the target pressure $P_S$ of side guides for the unilateral side guide 11 can be obtained according to a fifth formula shown as $P_S=P_S'+\Delta P_S$, wherein $P_S'$ is the pressure on the unilateral side guide 11 before adjustment. Then adjusting the position of the unilateral side guide 11 so that the pressure on the unilateral side guide 11 is consistent with the target pressure $P_S$ of side guides.

The calculation and control process of the dynamic adjusting step is usually accomplished by the industrial control PLC. The detection system conveys the spark width $M_S$ to the industrial control PLC, during the coiling process of the hot rolled strip 20, PLC calculates the position or pressure adjustment magnitude according to the spark width $M_S$ of the unilateral side guide 11 based on the formulas, and then controls the adjustment of the unilateral side guides. In the present embodiment, for each unilateral side guide 11, it can be controlled and adjusted according to the spark width $M_S$, which is the core part of this invention. In the present embodiment, the friction and contact between the side guides 11 and the hot rolled strip 20 are judged according to the sparks from the friction between the side guides 11 and the hot rolled strip 20, and to control and adjust the side guides 11 based on this. Therefore, the control method of the side guides 11 is optimized, and the hot rolled strip 20 is always in the relative center of the steel coil, the wear of the side guides is reduced, and various defects of the coil is avoided. For the controlled adjustment of the side guides 11 on both sides according to the spark width $M_S$, there are two methods in the present embodiment, one is the position controlled adjusting method, which is to control and adjust the position of the two side guides 11, the other is the pressure controlled adjusting method, which is to control and adjust the pressure on either side of the side guides 11. Both the position controlled adjusting method and the pressure controlled adjusting method control and adjust the side guides 11 according to the width of the sparks from the friction between the side guides 11 and the hot rolled strip 20. The main difference is that the position controlled adjusting method is to convert the spark width deviation into the position adjustment magnitude of the side guides 11, while the pressure controlled adjusting method is to convert the spark width deviation into the pressure adjustment magnitude of the side guides 11. The position controlled adjusting method is mainly for the thin gauge hot rolled strip 20, and the pressure controlled adjusting method is mainly for the heavy gauge hot rolled strip 20. Since the thin gauge hot rolled strip 20 is prone to have edge cracks if the pressure controlled adjusting method is used, the position controlled adjusting method is needed to minimize the contact between the side guides 11 and the hot rolled strip 20.

Referring to FIG. 3, it should be noted that the position of the unilateral side guide is the distance between the side guide and the centerline of the rolls of hot rolling mill. As shown by the double arrows corresponding to $W_{DS}$ and $W_{WS}$ in FIG. 3, $W_{DS}$ represents the position of the side guide on the drive side, and $W_{WS}$ represents the position of the side guide on the work side. The opening of the side guides refers to the distance between two side guides, which is the sum of $W_{DS}$ and $W_{WS}$ in FIG. 3. It should also be noted that the pressure on the unilateral side guide is the counterforce applied to the side guide by the hot rolled strip 20 when the side guides are in contact with the hot rolled strip 20 and will be sensed by pressure sensors on the drive side of the side guides and transmitted to the industrial control PLC.

More specifically, said step of dynamic adjustment specifically comprises a first dynamic adjusting step, a second dynamic adjusting step, a third dynamic adjusting step, and a fourth dynamic adjusting step.

The first dynamic adjusting step: this step starting from the head of the hot rolled strip 20 reaches the coiler pinch rolls 12 and till the tail of the hot rolled strip 20 is out of an F1 stand 1. This step comprises: setting the target spark width $M_{aim}$ as a first target spark width $M_{aim1}$. After the head of the hot rolled strip 20 reaches the coiler pinch rolls 12, performing a dynamic adjusting process for each unilateral side guide 11 until the head of the hot rolled strip 20 goes out of the coiler pinch rolls 12 by a length of $L_{head}$, wherein $L_{head}$ is a preset length of the strip head. The value of the length of the strip head $L_{head}$ ranges from 10~40 m. This step further comprises: when the head of the hot rolled strip 20 goes out of said coiler pinch rolls 12 by length that exceeds said length of the strip head $L_{head}$, recording the real-time position of said unilateral side guide 11 as a target lock position $W_{LK}$, then adjusting the position of said unilateral side guide 11 to $W_{LK}+\Delta W_3$, and locking the position of said unilateral side guide 11 until the tail of the hot rolled strip 20 is out of the F1 stand 1, wherein $\Delta W_3$ is a preset target position margin. The value range of the target position margin is 1~5 mm. In the process of this step, the side guides 11 are out of contact with the hot rolled strip 20, then the wear of the side guides 11 are reduced, and the edge quality of the hot rolled strip 20 can be improved.

The second dynamic adjusting step: this step starting from the tail of the hot rolled strip 20 being out of the F1 stand 1 and till the tail of the hot rolled strip 20 is out of the F7 stand 7. This step comprises: setting the target spark width $M_{aim}$ as a second target spark width $M_{aim2}$, and then performing said dynamic adjusting process for each unilateral side guide 11.

The third dynamic adjusting step: this step starting from the tail of the hot rolled strip 20 being out of said F7 stand 7 until the tail of the hot rolled strip 20 is X meters away from the side guides 11, wherein X is a preset length parameter, which ranges from 20~30 m. This step comprises: setting the target spark width $M_{aim}$ as a third target spark width $M_{aim3}$, and then performing said dynamic adjusting process for each unilateral side guide 11.

The fourth dynamic adjusting step: this step starting from the tail of the hot rolled strip 20 being X meters away from the side guides 11 until the tail of the hot rolled strip 20 is out of the coiler pinch rolls 12. This step comprises: setting the target spark width $M_{aim}$ as a fourth target spark width $M_{aim4}$, and then performing said dynamic adjusting process for each unilateral side guide 11.

Specifically, the first target spark width to the fourth target spark width can be set according to the thickness of the hot rolled strip 20 and other influencing factors such as the coil shape and the wear of the strip edge during the production process.

In addition, both the position controlled adjusting method and the pressure controlled adjusting method need to have certain limits on the magnitude of the controlled adjustment, which is mainly to avoid the distance of the centerline of the hot rolled strip 20 deviating from the centerline of the coiler 16 is too large, leading to the coiling failure.

Therefore, the dynamic adjusting process for side guides in said step of dynamic adjustment further comprises setting amplitude limitation for the position of said unilateral side guide 11. Said amplitude limitation for the position includes an upper limit of the position $LIM_{up1}$ and a lower limit of the position $LIM_{low1}$. Said upper limit of the position $LIM_{up1}$ can be obtained according to a sixth formula and said lower limit of the position $LIM_{low1}$ can be obtained according to a seventh formula. Said sixth formula is $$LIM_{up1} = \frac{1}{2}W_{ave} + 50,$$

and said seventh formula is $$LIM_{low1} = \frac{1}{2}W_{ave} - 50,$$

wherein $W_{ave}$ is an average width of the hot rolled strip 20 when it goes out of the width gauge 8 by a length range L1, and L1 is a preset length of width measure. The value range of L1 is 20~50 m.

In addition to setting the amplitude of the position, the pressure controlled adjusting method in said step of dynamic adjustment further comprises setting amplitude limitation for the pressure of said unilateral side guide 11. Said amplitude limitation for the pressure includes an upper limit of the pressure $LIM_{up2}$ and a lower limit of the pressure $LIM_{low2}$. Said upper limit of the pressure $LIM_{up2}$ can be obtained according to an eighth formula and said lower limit of the pressure $LIM_{low2}$ can be obtained according to a ninth formula. Said eighth formula is $LIM_{up2}=(1+k1)P_{S_aim}$, and said ninth formula is $LIM_{low2}=(1-k1)P_{S_aim}$, wherein the value of k1 ranges from 0~0.5, and $P_{S_aim}$ is a preset target of controlled pressure. Specifically, the target of the controlled pressure is determined according to the production process, and the main considerations are factors such as the final coil shape, the wear of the strip edge and the loss of the side guide liner.

In the present embodiment, the control method of the side guides further comprises:

The step of final opening adjustment: when the tail of the hot rolled strip 20 is out of the coiler pinch rolls 12, and if there is no subsequent hot rolled strip 20 to be coiled, adjusting the opening of the side guides 11 to a final opening W7. Said final opening W7 is equal to said first preparatory opening W1 in said first preparatory opening adjusting step. The position of each unilateral side guide 11 is adjusted to $$\frac{1}{2}W7.$$

If there is subsequent hot rolled strip 20 to be coiled, then repeating the preparatory opening adjusting step to the final opening adjusting step.

The present embodiment provides the specific example 1 and the specific example 2 to specify the technical solutions.

Specific Example 1

Figure 4:
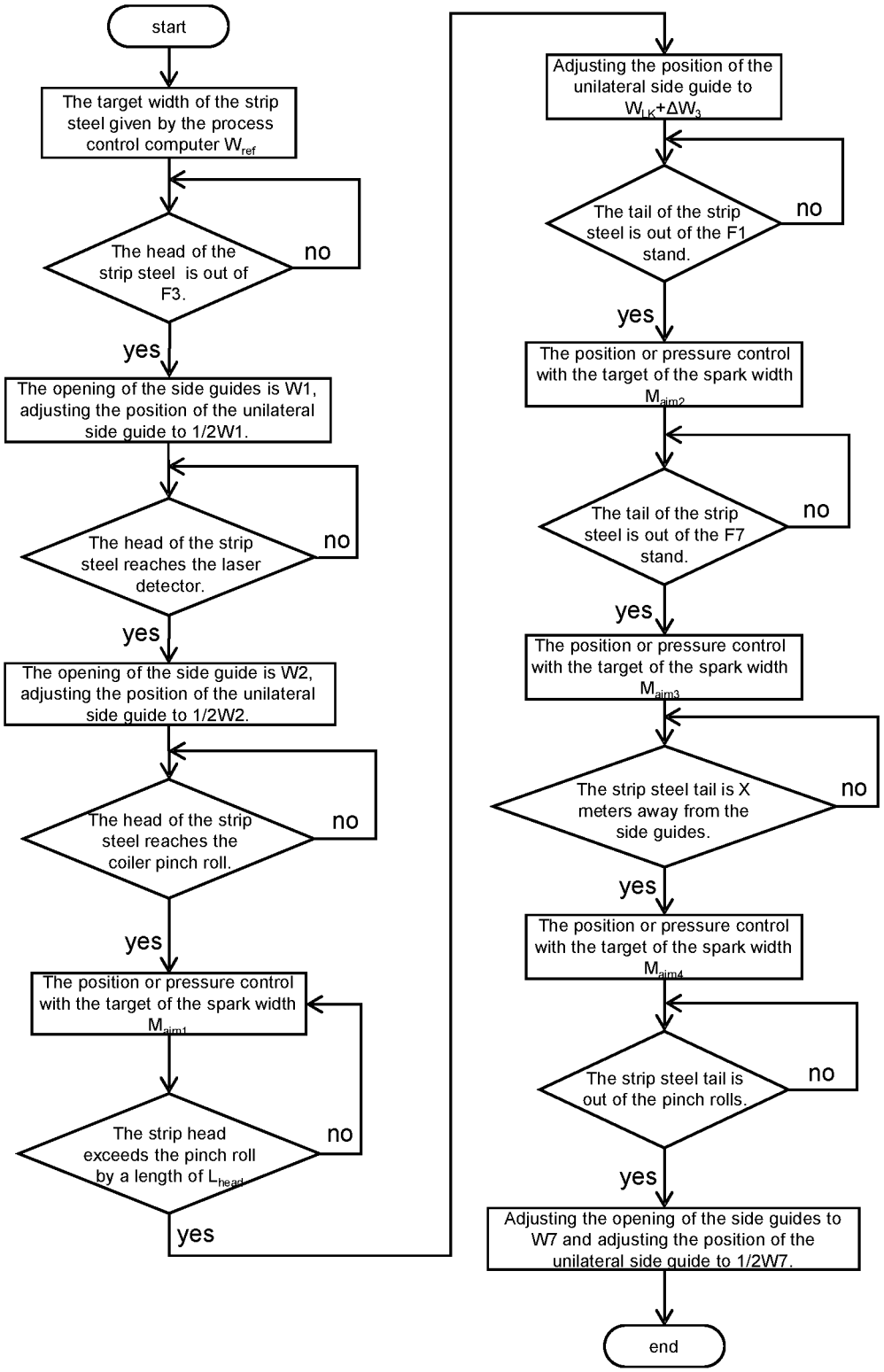
FIG. 4 is a flow chart of the control method of hot mill coiler side guides based on spark recognition according to the present invention.

Step of Preparatory Opening Adjustment:

Referring to FIG. 4, before the hot rolled strip 20 enters the area of the side guides 11, adjusting the opening of the side guides 11 to a preparatory opening.

The First Preparatory Opening Adjusting Step:

The target width $W_{ref}$ of the hot rolled strip 20 given by the process control computer is 1200 mm. When the head of the hot rolled strip is out of the F3 stand 3, setting the opening margin of the side guides $l_1$ as 50 mm. According to the tenth formula, $W1=W_{ref}+l_1=1250$ mm. Adjusting the opening of the side guides 11 to a first preparatory opening W1, and for each unilateral side guide 11, adjusting the position of said unilateral side guide 11 to $$\frac{1}{2}W1 = 625 \text{ mm}.$$

The Second Preparatory Opening Adjusting Step:

When the head of the hot rolled strip 20 reaches the laser detector 10, the detection system calculates the average width $W_{ave}$ of the hot rolled strip 20 when it goes out of the width gauge 8 by a length range L1 (L1=30 m) according to the real-time measurement of the width gauge 8, and $W_{ave}=1210$ mm. The deviation of the hot rolled strip 20 when it goes out of the width gauge 8 by the length range L1 (L1=30 m) is 10 mm. The opening margin of side guides $l_2$ is 20 mm. According to the eleventh formula, $W2=W_{ave}+l_{dev}+l_2=1240$ mm. Adjusting the opening of the side guides 11 to a second preparatory opening W2, and for each unilateral side guide 11, adjusting the position of the unilateral side guide 11 to $$\frac{1}{2}W2 = 620 \text{ mm}.$$

Step of Installation:

Installing the industrial camera 9 obliquely above the entrance of the side guides 11, the range of said industrial camera 9 covers the whole area of each side guide 11, and the industrial camera 9 transmitting the captured images to the detection system in real time via a communication line. The vertical height H from the industrial camera 9 to the hot rolled strip 20 is 4.18 m, and the horizontal distance L between the position where the industrial camera 9 is installed and the end of the side guides 11 is 8 m.

Step of Image Analysis:

For each unilateral side guide 11, the detection system implements a real-time analysis on the images of sparks taken by the industrial camera 9, wherein the sparks come from friction between the unilateral side guide 11 and the hot rolled strip 20, so as to identify the single spark with the largest transverse width generated on the unilateral side guide 11, and the transverse width of the spark is recorded as a spark width $M_S$. In the present specific example, the detection system transmits the identified spark width $M_S$ to the industrial control PLC, and the identification delay time is controlled within 50 ms.

Step of Dynamic Adjustment:

This step starts from the head of the hot rolled strip 20 reaches the coiler pinch rolls 12 and till the tail of the hot rolled strip 20 is out of said coiler pinch rolls 12. The reference thickness h is set as 3 mm, and the thickness of the hot rolled strip $h_{strip}$=2.5 mm.

The step of dynamic adjustment comprises the first dynamic adjusting step, the second dynamic adjusting step, the third dynamic adjusting step and the fourth dynamic adjusting step.

The First Dynamic Adjusting Step:

The thickness of the hot rolled strip 20 $h_{strip} \leq h$, thus the position controlled adjusting method is adopted.

When the head of the hot rolled strip 20 reaches the coiler pinch rolls 12, the target spark width $M_{aim}$ is set as a first target spark width $M_{aim1}$=10 mm. According the first formula, the second formula and the third formula, continuously dynamic calculating of the target position $W_S$ of the side guides, and then adjusting the position of the unilateral side guide to the target position of the side guides $W_S$. For example, the detection system analyzes the images of the unilateral side guide 11 and obtains the spark width of the unilateral side guide 11 $M_S$=11 mm. According to the first formula, $\Delta M_S = M_S - M_{aim} = 1$ mm. Then according to the second formula, $$\Delta W_S = K_{total1} \times \left(K_{P1} + \frac{K_{I1}}{s}\right) \times \Delta M_S,$$

performing the control of the dynamic proportion and integral, and finally obtaining a $\Delta W_S$ of 0.3 mm. If the position of the side guide before adjustment $W_S'$=620 mm, according to the third formula, $W_S = W_S' + \Delta W_S = 620.3$ mm. Repeating the dynamic adjusting process until the head of the hot rolled strip 20 goes out of the coiler pinch rolls 12 by a length of $L_{head}$, wherein $L_{head}$ is a preset length of the head of the strip, and $L_{head}$ is preset as 30 m.

When the head of the hot rolled strip 20 goes out of said coiler pinch rolls 12 by a length that exceeds said length of the strip head $L_{head}$, for example, the real-time position is 622 mm, recording the real-time position of said unilateral side guide 11 as a target lock position $W_{LK}$=622 mm. The preset target position margin $\Delta W_3$ is 2 mm, then adjusting the position of said unilateral side guide 11 to $W_{LK} + \Delta W_3$=624 mm, and locking the position of said unilateral side guide 11 until the tail of the hot rolled strip 20 is out of the F1 stand 1.

The Second Dynamic Adjusting Step:

When the tail of the hot rolled strip 20 is out of the F1 stand 1, setting the target spark width $M_{aim}$ as the second target spark width $M_{aim2}$=10 mm. According the first formula, the second formula and the third formula, continuously dynamic calculating of the target position $W_S$ of the side guides, and then adjusting the position of the unilateral side guide to the target position of the side guides $W_S$ until the tail of the hot rolled strip 20 is out of the F7 stand 7. The method of calculation and control is the same as that of the first target spark width $M_{aim1}$.

The Third Dynamic Adjusting Step:

The preset length parameter X=25 m, when the tail of the hot rolled strip 20 is out of said F7 stand 7, setting the target spark width $M_{aim}$ as a third target spark width $M_{aim3}$=10 mm. According the first formula, the second formula and the third formula, continuously dynamic calculating of the target position $W_S$ of the side guides, and then adjusting the position of the unilateral side guide 11 to the target position of the side guides $W_S$ until the tail of the hot rolled strip 20 is X meters away from the side guides 11. The method of calculation and control is the same as that of the first target spark width $M_{aim1}$.

The Fourth Dynamic Adjusting Step:

When the tail of the hot rolled strip 20 is X meters away from the side guides 11, setting the target spark width $M_{aim}$ as a fourth target spark width $M_{aim4}$=20 mm. According the first formula, the second formula and the third formula, continuously dynamic calculating of the target position $W_S$ of the side guides, and then adjusting the position of the unilateral side guide 11 to the target position of the side guides $W_S$ until the tail of the hot rolled strip 20 is out of the coiler pinch rolls 12. The method of calculation and control is the same as that of the first target spark width $M_{aim1}$.

Step of Final Opening Adjustment:

When the tail of the hot rolled strip 20 is out of the coiler pinch rolls 12, there is no subsequent hot rolled strip 20 to be coiled, adjusting the opening of the side guides 11 to a final opening W7=W1=1250 mm, and then adjusting the position of each unilateral side guide 11 to $$\frac{1}{2}W7 = 625 \text{ mm}.$$

During the controlled adjusting process of the position of the side guides, setting amplitude limitation for the position of the side guides.

The average width $W_{ave}$ of the hot rolled strip 20 after it goes out of the width gauge 8 by a length range L1 (L1=30 m) is 1210 mm. According the sixth formula, the upper limit of the position of said unilateral side guide 11

$$LIM_{up1} = \frac{1}{2}W_{ave} + 50 = 655 \text{ mm}.$$

According to a seventh formula, the lower limit of the position of the unilateral side guide $$LIM_{low1} = \frac{1}{2}W_{ave} - 50 = 555 \text{ mm}.$$

The range of the limits of the amplitude of the position is 555~655 mm.

Specific Example 2

Step of Preparatory Opening Adjustment:

Referring to FIG. 4, before the hot rolled strip 20 enters the area of the side guides 11, adjusting the opening of the side guides 11 to a preparatory opening.

The First Preparatory Opening Adjusting Step:

The target width $W_{ref}$ of the hot rolled strip 20 given by the process control computer is 1000 mm. When the head of the hot rolled strip is out of the F3 stand 3, setting the opening margin of the side guides $l_1$ as 40 mm. According to the tenth formula, $W_1=W_{ref}+l_1=1040$ mm. Adjusting the opening of the side guides 11 to a first preparatory opening W1, and for each unilateral side guide 11, adjusting the position of said unilateral side guide 11 to $$\frac{1}{2}W1 = 520 \text{ mm}.$$

The second preparatory opening adjusting step:

When the head of the hot rolled strip 20 reaches the laser detector 10, the detection system calculates the average width $W_{ave}$ of the hot rolled strip 20 when it goes out of the width gauge 8 by a length range L1 (L1=30 m) according to the real-time measurement of the width gauge 8, and $W_{ave}=1012$ mm. The deviation of the hot rolled strip 20 when it goes out of the width gauge 8 by the length range L1 (L1=30 m) is 8 mm. The opening margin of side guides $l_2$ is 16 mm. According to the eleventh formula, $W_2=W_{ave}+l_{dev}+_2=1036$ mm. Adjusting the opening of the side guides 11 to a second preparatory opening W2, and then adjusting the position of the unilateral side guide $$\frac{1}{2}W2 = 518 \text{ mm}.$$

Step of Installation:

Installing the industrial camera 9 obliquely above the entrance of the side guides 11, the range of said industrial camera 9 covers the whole area of each side guide 11, and the industrial camera 9 transmitting the captured images to the detection system in real time via a communication line. The vertical height H from the industrial camera 9 to the hot rolled strip 20 is 4.18 m, and the horizontal distance L between the position where the industrial camera 9 is installed and the end of the side guides 11 is 8 m.

Step of Image Analysis:

For each unilateral side guide 11, the detection system implements a real-time analysis on the images of sparks taken by the industrial camera 9, wherein the sparks come from friction between the unilateral side guide 11 and the hot rolled strip 20, so as to identify the single spark with the largest transverse width generated on the unilateral side guide 11, and the transverse width of the spark is recorded as a spark width $M_S$. In the present specific example, the detection system transmits the identified spark width $M_S$ to the industrial control PLC, and the identification delay time is controlled within 50 ms.

Step of Dynamic Adjustment:

This step starts from the head of the hot rolled strip 20 reaches the coiler pinch rolls 12 and till the tail of the hot rolled strip 20 is out of said coiler pinch rolls 12. The reference thickness h is set as 3 mm, and the thickness of the hot rolled strip 20 $h_{strip}=4$ mm.

The step of dynamic adjustment comprises the first dynamic adjusting step, the second dynamic adjusting step, the third dynamic adjusting step and the fourth dynamic adjusting step.

The First Dynamic Adjusting Step:

The thickness of the hot rolled strip 20 $h_{strip}>h$, thus the pressure controlled adjusting method is adopted.

When the head of the hot rolled strip 20 reaches the coiler pinch rolls 12, the target spark width $M_{aim}$ is set as a first target spark width $M_{aim1}=10$ mm. According the first formula, the fourth formula and the fifth formula, continuously dynamic calculating of the target pressure $P_S$ on the side guides, and then adjusting the pressure on the unilateral side guide to the target pressure on the side guides $P_S$. It should be noted that since the spark width of the unilateral side guide 11 is from the friction between the unilateral side guide 11 and the hot rolled strip 20, when the spark width of the unilateral side guide 11 is greater than the first target spark width $M_{aim1}$, approximately, the pressure between the unilateral side guide 11 and the hot rolled strip 20 is too large, thus the pressure on the unilateral side guide 11 $P_S$ should be reduced. For example, the detection system analyzes the images of the unilateral side guide 11 and obtains the spark width of the unilateral side guide 11 $M_S=11$ mm. According to the first formula, $\Delta M_S=M_S-M_{aim}=1$ mm. Then according to the fourth formula, $$\Delta P_S = K_{total2} \times \left(K_{P2} + \frac{K_{I2}}{s}\right) \times \Delta M_S,$$

performing the control of the dynamic proportion and integral, and finally obtaining a $\Delta P_S$ of −0.8 kN. If the pressure on the side guide before adjustment $P_S'=1$ kN, according to the fifth formula $P_S=P_S'+\Delta P_S=10.2$ kN. Repeating the dynamic adjusting process until the head of the hot rolled strip 20 goes out of the coiler pinch rolls 12 by a length of $L_{head}$, wherein $L_{head}$ is a preset length of the head of the strip, and $L_{head}$ is preset as 30 m.

When the head of the hot rolled strip 20 goes out of said coiler pinch rolls 12 by a length that exceeds said length of the strip head $L_{head}$, for example, the real-time position is 622 mm, recording the real-time position of said unilateral side guide 11 as a target lock position $W_{LK}=622$ mm. The preset target position margin $\Delta W_3$ is 2 mm, then adjusting the position of said unilateral side guide 11 to $W_{LK}+\Delta W_3=624$ mm, and then fixing the position of said unilateral side guide 11 until the tail of the hot rolled strip 20 is out of the F1 stand 1.

The Second Dynamic Adjusting Step:

When the tail of the hot rolled strip 20 is out of the F1 stand 1, setting the target spark width $M_{aim}$ as the second target spark width $M_{aim2}=10$ mm. According the first formula, the fourth formula and the fifth formula, continuously dynamic calculating of the target pressure $P_S$ on the side guides, and then adjusting the pressure on the unilateral side guide to the target pressure on the side guides $P_S$ until the tail of the hot rolled strip 20 is out of the F7 stand 7. The method of calculation and control is the same as that of the first target spark width $M_{aim1}$.

The Third Dynamic Adjusting Step:

The preset length parameter X=25 m, when the tail of the hot rolled strip 20 is out of said F7 stand 7, setting the target spark width $M_{aim}$ as a third target spark width $M_{aim3}$=10 mm. According the first formula, the fourth formula and the fifth formula, continuously dynamic calculating of the target pressure $P_S$ on the side guides, and then adjusting the pressure on the unilateral side guide 11 to the target pressure on the side guides $P_S$ until the tail of the hot rolled strip 20 is X meters away from the side guides 11. The method of calculation and control is the same as that of the first target spark width $M_{aim1}$.

The Fourth Dynamic Adjusting Step:

When the tail of the hot rolled strip 20 reaches X meters in front of the side guides 11, setting the target spark width $M_{aim}$ as a fourth target spark width $M_{aim4}$=20 mm. According the first formula, the fourth formula and the fifth formula, continuously dynamic calculating of the target pressure $P_S$ on the side guides, and then adjusting the pressure on the unilateral side guide 11 to the target pressure on the side guides $P_S$ until the tail of the hot rolled strip 20 is out of the coiler pinch rolls 12. The method of calculation and control is the same as that of the first target spark width $M_{aim1}$.

Step of Final Opening Adjustment:

When the tail of the hot rolled strip 20 is out of the coiler pinch rolls 12, there is no subsequent hot rolled strip 20 to be coiled, adjusting the opening of the side guides 11 to a final opening W7=W1=1040 mm, and then adjusting the position of each unilateral side guide 11 to $$\frac{1}{2}W7 = 520 \text{ mm}.$$

During the controlled adjusting process of the position of the side guides, setting amplitude limitation for the pressure on the side guides.

Setting the target of the controlled pressure $P_{S_aim}$ as 10 kN, and the value of k1 is 0.5. According to an eighth formula, the upper limit of the pressure on the unilateral side guide 11 $LIM_{up2}=(1+k1)P_{S_aim}$=15 kN. According to a ninth formula, the lower limit of the pressure on the unilateral side guide 11 $LIM_{low2}=(1-k1)P_{S_aim}$=5 kN. The range of the limits of the amplitude of the pressure is 5~15 kN.

The above embodiments are only used to illustrate the present invention, but not used to limit the present invention. Changes and modifications made to the above embodiments without departing from the essential spirit scope of the present invention shall all fall within the scope of the claims of the present invention.

What is claimed is:

1. A control method of coiler side guides associated with a hot mill based on a spark recognition, the control method comprising:

a step of preparatory opening adjustment: before a hot rolled strip enters an area of the side guides, adjusting the opening of the side guides to a preparatory opening;

a step of installation: installing an industrial camera obliquely above an entrance of two side guides, the range of the industrial camera covering a whole area of each side guide, and the industrial camera transmitting captured images to a detection system in real time via a communication line;

a step of image analysis: for each unilateral side guide, a detection system implementing a real-time analysis on images of sparks taken by the industrial camera, wherein the sparks come from friction between the unilateral side guide and the hot rolled strip, so as to identify a single spark having a largest transverse width generated on the unilateral side guide, and the transverse width of the single spark being recorded as spark width $M_S$;

a step of dynamic adjustment: this step starting from a head of the hot rolled strip reaching coiler pinch rolls associated with the hot mill till a tail of the hot rolled strip is out of the coiler pinch rolls;

the step of dynamic adjustment comprising: setting a target spark width $M_{aim}$, and performing a dynamic adjusting process for each unilateral side guide;

the dynamic adjusting process for each unilateral side guide comprising: obtaining a spark width deviation $\Delta M_S$ of the unilateral side guide according to a first formula shown as $\Delta M_S=M_S-M_{aim}$, and implementing a controlling adjusting method for the unilateral side guide according to the spark width deviation, $\Delta M_S$ of the unilateral side guide, wherein when a thickness of the hot rolled strip, $h_{strip}\leq h$, the controlling adjusting method for side guides is a position controlled adjusting method, and when the thickness of the hot rolled strip $h_{strip}>h$, the controlled adjusting method of side guides is a pressure controlled adjusting method, wherein h is a preset reference thickness;

the position controlled adjusting method comprising: obtaining a position adjustment magnitude $\Delta W_S$ of the unilateral side guide according to a second formula shown as $$\Delta W_S = K_{totol1} \times \left(K_{P1} + \frac{K_{I1}}{s}\right) \times \Delta M_S,$$

wherein $K_{total1}$ is total gain, $K_{P1}$ is proportional coefficient, $K_{I1}$ is integral coefficient, S is Laplace operator, then obtaining a target position $W_S$ of the unilateral side guide according to a third formula shown as $W_S=W_S'+\Delta W_S$, wherein $W_S'$ is the position of the unilateral side guide before adjustment, and adjusting the position of the unilateral side guide to the target position $W_S'$ of the unilateral side guide;

the pressure controlled adjusting method comprising: obtaining a pressure adjustment magnitude $\Delta P_S$ of the unilateral side guide according to a fourth formula shown as $$\Delta P_S = K_{totol2} \times \left(K_{P2} + \frac{K_{I2}}{s}\right) \times \Delta M_S,$$

wherein $K_{total2}$ is total gain, $K_{P2}$ is proportional coefficient, $K_{I2}$ is integral coefficient, S is Laplace operator, then obtaining a target pressure $P_S$ of side guides for the unilateral side guide according to a fifth formula shown as $P_S=P_S'+\Delta P_S$, wherein $P_S'$ is the pressure on the unilateral side guide before adjustment, and adjusting the position of the unilateral side guide so that the pressure on the unilateral side guide is consistent with the target pressure $P_S$ of side guide.

2. The control method of coiler side guides associated with the hot mill based on the spark recognition of claim 1, wherein the step of dynamic adjustment comprises:

a first dynamic adjusting step: this step starting from the head of the hot rolled strip reaching the coiler pinch rolls till the tail of the hot rolled strip is out of an F1 stand;

the first dynamic adjusting step comprising: setting the target spark width $M_{aim}$ as a first target spark width $M_{aim1}$, after the head of the hot rolled strip reaches the coiler pinch rolls, performing a dynamic adjusting process for each unilateral side guide until the head of the hot rolled strip goes out of the coiler pinch rolls by a length of $L_{head}$, wherein $L_{head}$ is a preset length of the strip head;

the first dynamic adjusting step further comprising: when the head of the hot rolled strip goes out of the coiler pinch rolls by a length that exceeds the length of the strip head $L_{head}$, recording a real-time position of the unilateral side guide as a target lock position $W_{LK}$, then adjusting the position of the unilateral side guide to $W_{LK}+\Delta W_3$, and locking the position of the unilateral side guide until the tail of the hot rolled strip is out of the F1 stand, wherein $\Delta W_3$ is a preset target position margin.

3. The control method of coiler side guides associated with the hot mill based on the spark recognition of claim 2, wherein the step of dynamic adjustment further comprises:

a second dynamic adjusting step: this step starting from the tail of the hot rolled strip being out of the F1 stand and till the tail of the hot rolled strip is out of an F7 stand, the second dynamic adjusting step comprising: setting the target spark width $M_{aim}$ as a second target spark width $M_{aim2}$, and then performing the dynamic adjusting process for each unilateral side guide.

4. The control method of coiler side guides associated with the hot mill based on the spark recognition of claim 3, wherein the step of dynamic adjustment further comprises:

a third dynamic adjusting step: this step starting from the tail of the hot rolled strip being out of the F7 stand until the tail of the hot rolled strip is X meters away from the side guides, wherein X is a preset length parameter, the third dynamic adjusting step comprising: setting the target spark width $M_{aim}$ as a third target spark width $M_{aim3}$, and then performing the dynamic adjusting process for each unilateral side guide.

5. The control method of coiler side guides associated with the hot mill based on the spark recognition of claim 4, wherein the step of dynamic adjustment further comprises:

a fourth dynamic adjusting step: this step starting from the tail of the hot rolled strip being X meters away from the side guides until the tail of the hot rolled strip is out of the coiler pinch rolls, the fourth dynamic adjusting step comprising: setting the target spark width $M_{aim}$ as a fourth target spark width $M_{aim4}$, and then performing the dynamic adjusting process for each unilateral side guide.

6. The control method of coiler side guides associated with the hot mill based on the spark recognition of claim 1, wherein the dynamic adjusting process for side guides in the step of dynamic adjustment further comprises: setting an amplitude limitation for the position of the unilateral side guide, the amplitude limitation for the position including an upper limit of the position $LIM_{up1}$ and a lower limit of the position $LIM_{low1}$, the upper limit of the position $LIM_{up1}$ being obtained according to a sixth formula, and the lower limit of the position $LIM_{low1}$ being obtained according to a seventh formula, the sixth formula being $$LIM_{up1} = \frac{1}{2}W_{ave} + 50,$$

and the seventh formula being $$LIM_{low1} = \frac{1}{2}W_{ave} - 50,$$

wherein $W_{ave}$ is an average width of the hot rolled strip when it goes out of a width gauge by a length range L1, and L1 is a preset length of width measure, the width gauge is provided at the rear side of the hot mill stands and measures the width of the hot rolled strip out of the mill in real time.

7. The control method of coiler side guides associated with the hot mill based on the spark recognition of claim 1, wherein the pressure controlled adjusting method in the step of dynamic adjustment further comprising: setting an amplitude for the pressure including an upper limit of the pressure $LIM_{up2}$ and a lower limit of the pressure $LIM_{low2}$ the upper limit of the pressure $LIM_{up2}$ being obtained according to an eighth formula, and the lower limit of the pressure $LIM_{low2}$ being obtained according to a ninth formula, the eighth formula being $LIM_{up2}=(1+k1)P_{S_aim}$, and the ninth formula being $LIM_{low2}=(1-k1)P_{S_aim}$, wherein the value of k1 ranges from 0~0.5, and $P_{S_aim}$ is a preset target of controlled pressure.

8. The control method of coiler side guides associated with the hot mill based on the spark recognition of claim 1, wherein in the step of preparatory opening adjustment, the adjusting the opening of the side guides to the preparatory opening comprises:

a first preparatory opening adjusting step: when the head of the hot rolled strip is out of a F3 stand, adjusting the opening of the side guides to a first preparatory opening W1, and for each unilateral side guide, adjusting the position of the unilateral side guide to $$\frac{1}{2}W1,$$

the first preparatory opening W1 being obtained according to a tenth formula, the tenth formula being $W1=W_{ref}+l_1$, wherein $W_{ref}$ is a target width value of the hot rolled strip given by a process control computer, $l_1$ is the opening margin of side guides, and the value of $l_1$ ranges from 40~60 mm.

9. The control method of coiler side guides associated with the hot mill based on the spark recognition of claim 8, wherein in the step of preparatory opening adjustment, the adjusting the opening of the side guides to the preparatory opening further comprises:

a second preparatory opening adjusting step: when the head of the hot rolled strip reaches a laser detector, adjusting the opening of the side guides to a second preparatory opening W2, and for each unilateral side guide, adjusting the position of the unilateral side guide to $$\frac{1}{2}W2,$$

the second preparatory opening W2 being obtained according to an eleventh formula;

the eleventh formula being $W2=W_{ave}+l_{dev}+l_2$, wherein $W_{ave}$ is an average width of the hot rolled strip when it goes out of a width gauge by a length range L1, $l_{dev}$ is the deviation of the hot rolled strip when it goes out of the width gauge by the length range L1, wherein L1 is a preset length of width measure, $l_2$ is the opening margin of side guides, and the value of $l_2$ ranges from 15~30 mm.

10. The control method of coiler side guides associated with the hot mill based on the spark recognition of claim 8, further comprising:

a step of final opening adjustment: when the tail of the hot rolled strip is out of the coiler pinch rolls, and if there is no subsequent hot rolled strip to be coiled, adjusting the opening of the side guides to a final opening W7, the final opening W7 being equal to the first preparatory opening W1 in the first preparatory opening adjusting step, and adjusting the position of each unilateral side guide to $$\frac{1}{2}W7.$$

11. The control method of coiler side guides associated with the hot mill based on the spark recognition of claim 6, wherein the pressure controlled adjusting method in the step of dynamic adjustment further comprising: setting an amplitude limitation for the pressure of said unilateral side guide, the amplitude limitation for the pressure including an upper limit of the pressure $LIM_{up2}$ and a lower limit of the pressure $LIM_{low2}$, the upper limit of the pressure $LIM_{up2}$ being obtained according to an eighth formula, and the lower limit of the pressure $LIM_{low2}$ being obtained according to a ninth formula, the eighth formula being $LIM_{up2}=(1+k1)P_{S_aim}$, and the ninth formula being $LIM_{low2}=(1+k1)P_{S_aim}$, wherein the value of k1 ranges from 0~0.5, and $P_{S_aim}$ is a preset target of controlled pressure.

12. The control method of coiler side guides associated with the hot mill based on the spark recognition of claim 9, further comprising:

a step of final opening adjustment: when the tail of the hot rolled strip is out of the coiler pinch rolls, and if there is no subsequent hot rolled strip to be coiled, adjusting the opening of the side guides to a final opening W7, the final opening W7 being equal to the first preparatory opening W1 in the first preparatory opening adjusting step, and adjusting the position of each unilateral side guide (11) to $$\frac{1}{2}W7.$$

* * * * *